US009754546B2

(12) United States Patent
Kim et al.

(10) Patent No.: US 9,754,546 B2
(45) Date of Patent: Sep. 5, 2017

(54) DISPLAY PANEL DRIVING APPARATUS, METHOD OF DRIVING DISPLAY PANEL USING THE SAME AND DISPLAY APPARATUS HAVING THE SAME

(71) Applicant: SAMSUNG DISPLAY CO., LTD., Yongin-si, Gyeonggi-Do (KR)

(72) Inventors: Ju-Hyun Kim, Asan-si (KR); Ki-Hyun Pyun, Gwangmyeong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 115 days.

(21) Appl. No.: 14/936,899

(22) Filed: Nov. 10, 2015

(65) Prior Publication Data

US 2017/0011696 A1 Jan. 12, 2017

(30) Foreign Application Priority Data

Jul. 7, 2015 (KR) ..... 10-2015-0096668

(51) Int. Cl.
*G09G 3/36* (2006.01)
*G09G 5/00* (2006.01)

(52) U.S. Cl.
CPC ..... *G09G 3/3648* (2013.01); *G09G 5/008* (2013.01); *G09G 2320/02* (2013.01)

(58) Field of Classification Search
None
See application file for complete search history.

(56) References Cited

U.S. PATENT DOCUMENTS

2014/0292742 A1* 10/2014 Oh ..... G09G 3/3688 345/212
2015/0008885 A1 1/2015 Yoshida
2015/0009812 A1 1/2015 Tao et al.

FOREIGN PATENT DOCUMENTS

JP 2005-057484 3/2005
KR 1020030050336 6/2003
KR 1020100122624 11/2010

* cited by examiner

*Primary Examiner* — Nicholas Lee
(74) *Attorney, Agent, or Firm* — F. Chau & Associates, LLC

(57) ABSTRACT

A display panel driving apparatus includes a load controlling circuit, a data driver and a gate driver. The load controlling circuit is connected to a control line transferring a recovery timing control signal for controlling recovery of a clock signal from a display signal including image data and the clock signal, and is configured to control a load of the control line according to a glitch level of the recovery timing control signal. The data driver is configured to receive the display signal, receive the recovery timing control signal through a connection to the control line, recover the clock signal from the display signal according to the recovery timing control signal, and output a data signal based on the image data to a data line of a display panel.

20 Claims, 8 Drawing Sheets

DISPLAY PANEL DRIVING APPARATUS, METHOD OF DRIVING DISPLAY PANEL USING THE SAME AND DISPLAY APPARATUS HAVING THE SAME

CROSS-REFERENCE TO RELATED APPLICATIONS

This application claims priority under 35 U.S.C. §119 to Korean Patent Application No. 10-2015-0096668, filed on Jul. 7, 2015 in the Korean Intellectual Property Office (KIPO), the disclosure of which is incorporated by reference in its entirety herein.

BACKGROUND

1. Technical Field

Exemplary embodiments of the present inventive concept relate to a display panel driving apparatus, a method of driving a display panel using the display panel driving apparatus, and a display apparatus having the display panel driving apparatus.

2. Discussion of Related Art

A display apparatus such as a liquid crystal display apparatus includes a display panel and a display panel driving apparatus.

The display panel includes gate lines, data lines and pixels.

The display panel driving apparatus includes a gate driving part driving the gate lines, a data driving part driving the data lines, and a timing controlling part controlling a timing of the gate driving part and the data driving part.

The timing controlling part outputs a vertical start signal and a first clock signal to the gate driving part. In addition, the timing controlling part outputs image data, a horizontal start signal and a second clock signal to the data driving part. Here, the timing controlling part may transmit a display signal including the image data and the second clock signal to the data driving part through one line. In this case, the data driving part recovers the second clock signal from the display signal. The data driving part recovers the second clock signal from the display signal according to a recovery timing control signal.

However, when a distortion or a glitch is present in the recovery timing control signal, the data driving part may not be able to correctly recover the second clock signal.

SUMMARY

At least one exemplary embodiment of the present inventive concept provides a display panel driving apparatus capable of improving display quality of a display apparatus.

At least one exemplary embodiment of the present inventive concept provides a method of driving a display panel using the above-mentioned display panel driving apparatus.

At least one exemplary embodiment of the present inventive concept also provides a display apparatus having the above-mentioned display panel driving apparatus.

According to an exemplary embodiment of the present inventive concept, a display panel driving apparatus includes a load controlling circuit, a data driver and a gate driver. The load controlling circuit is connected to a control line transferring a recovery timing control signal for controlling a recovery of a clock signal from a display signal including image data and the clock signal, and is configured to control a load of the control line according to a glitch level of the recovery timing control signal. The data driver is configured to receive the display signal, receive the recovery timing control signal through a connection to the control line, recover the clock signal from the display signal according to the recovery timing control signal, and output a data signal based on the image data to a data line of a display panel. The gate driving part is configured to output a gate signal to a gate line of the display panel.

In an exemplary embodiment, the display panel driving apparatus may further include a detecting circuit configured to detect the glitch level of the recovery timing control signal and output a glitch level signal indicating the glitch level.

In an exemplary embodiment, the load controlling circuit may receive the glitch level signal output from the detecting circuit and control the load of the control line according to the glitch level of the recovery timing control signal.

In an exemplary embodiment, the load controlling circuit may include a capacitance controlling circuit configured to receive the glitch level signal output from the detecting circuit and output a capacitance control signal according to the glitch level of the recovery timing control signal, and a capacitor circuit connected to the control line for changing a capacitance according to the capacitance control signal output from the capacitance controlling circuit.

In an exemplary embodiment, the capacitance controlling circuit may include a control circuit configured to output capacitance control data according to the glitch level signal output from the detecting circuit, and a digital to analog converter configured to convert the capacitance control data output from the control circuit into an analog type and output the capacitance control signal.

In an exemplary embodiment, the capacitance controlling circuit may further include a memory disposed between the control circuit and the digital to analog converter to store the capacitance control data output from the control circuit.

In an exemplary embodiment, the capacitor circuit may include a variable capacitance diode of which the capacitance is controlled according to the capacitance control signal.

In an exemplary embodiment, the variable capacitance diode may include a varactor device.

In an exemplary embodiment, the load controlling circuit may include a capacitance controlling circuit configured to receive the glitch level signal output from the detecting circuit and output a switch control data according to the glitch level of the recovery timing control signal, a switch circuit configured to open and close according to the switch control data output from the capacitance controlling circuit, and a capacitor circuit including a capacitor configured to be connected to or disconnected from the control line through the switch circuit.

In an exemplary embodiment, the capacitance controlling circuit may include a control circuit configured to output capacitance control data according to the glitch level signal output from the detecting circuit, and a data register configured to output the switch control data according to the capacitance control data output from the control circuit.

In an exemplary embodiment, the capacitance controlling circuit may further include a memory disposed between the control circuit and the data register to store the capacitance control data output from the control circuit.

In an exemplary embodiment, the switch circuit may include at least one switch that opens or closes according to the switch control data.

In an exemplary embodiment, the capacitor part circuit includes at least one capacitor connected to the switch.

In an exemplary embodiment, the load controlling circuit may increase the load of the recovery timing control line when the glitch level of the recovery timing control signal is greater than a threshold.

According to an exemplary embodiment of the present inventive concept, a method of driving a display panel includes detecting a glitch level of a recovery timing control signal for controlling recovery of a clock signal from a display signal including image data and the clock signal, controlling a load of a control line transferring the recovery timing control signal according to the glitch level of the recovery timing control signal, recovering the clock signal from the display signal according to the recovery timing control signal, recovering the image data from the display signal according to the clock signal, outputting a data signal based on the image data to a data line of the display panel, and outputting a gate signal to a gate line of the display panel.

In an exemplary embodiment, the controlling the load of the control line according to the glitch level of the recovery timing control signal may include controlling a capacitance of a capacitor circuit connected to the control line.

In an exemplary embodiment, the controlling the capacitance of the capacitor circuit may include outputting capacitance control data according to the glitch level of the recovery timing control signal, outputting a capacitance control signal by converting the capacitance control data into an analog type, and changing the capacitance of the capacitor circuit according to the capacitance control signal.

In an exemplary embodiment, the controlling the capacitance of the capacitor circuit may include outputting capacitance control data according to the glitch level of the recovery timing control signal, outputting switch control data according to the capacitance control data, and changing the capacitance of the capacitor circuit connected to the control line by controlling a switch disposed between the control line and the capacitor circuit according to the switch control data.

In an exemplary embodiment, the controlling the load of the control line transferring the recovery timing control signal may include increasing the load of the recovery timing control line when the glitch level of the recovery timing control signal is greater than a threshold.

According to an exemplary embodiment of the present inventive concept, a display apparatus includes a display panel and a display panel driving apparatus. The display panel includes a gate line, a data line and a pixel electrode electrically connected to the gate line and the data line. The display panel driving apparatus includes a load controlling circuit connected to a control line transferring a recovery timing control signal for controlling a recovery timing when a clock signal is recovered from a display signal including image data and the clock signal and configured to control a load of the recovery timing control line according to a glitch level of the recovery timing control signal, a data driver configured to receive the display signal, receive the recovery timing control signal through a connection to the control line, recover the clock signal from the display signal according to the recovery timing control signal and output a data signal based on the image data to the data line of the display panel, and a gate driver configured to output a gate signal to the gate line of the display panel.

According to at least one embodiment of the present inventive concept, a glitch generated in the recovery timing control signal may be decreased or removed. Thus, an error in which a data driver recognizes a high level of the recovery timing control signal as a low level or recognizes a low level of the recovery timing control signal as a high level may be prevented. Therefore, an operation error of the data driver may be prevented, and thus display quality of a display apparatus may be improved.

According to an exemplary embodiment of the inventive concept, a display panel driving apparatus includes: a detecting circuit, a control circuit, and a data driver. The detecting circuit is configured to detect a spike in a control line and output a detection signal indicating whether or not the spike has occurred. The control line transfers a recovery timing control signal to control recovery of a clock signal from a display signal including image data and the clock signal. The control circuit is configured to connect a capacitor of a first capacitance to the control line when the detection signal indicates the spike has not occurred and connect the capacitor of a second capacitance to the control line when the detection signal indicates the spike has occurred. The data driver is configured to receive the display signal, receive the recovery timing control signal through a connection to the control line, recover the clock signal from the display signal according to the recovery timing control signal, and output a data signal based on the image data to a data line of a display panel. In an embodiment, the capacitor is a varicap.

BRIEF DESCRIPTION OF THE DRAWINGS

The present inventive concept will become more apparent by describing in detail, exemplary embodiments thereof, with reference to the accompanying drawings, in which.

DETAILED DESCRIPTION OF THE EXEMPLARY EMBODIMENTS

Hereinafter, exemplary embodiments of the present inventive concept will be explained in detail with reference to the accompanying drawings.

Figure 1:
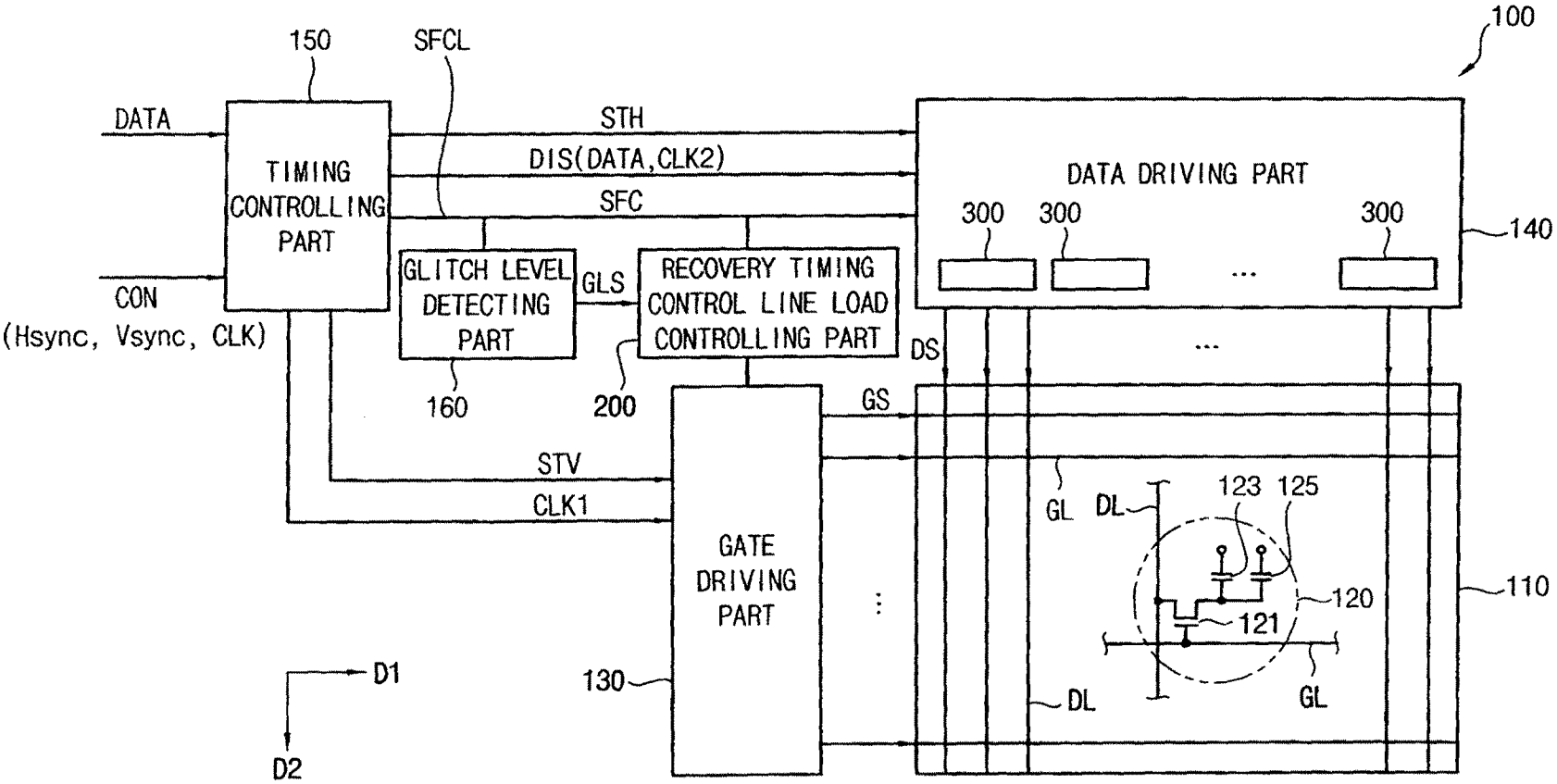
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 130 (e.g., a gate driver/circuit), a data driving part 140 (e.g., a data driver/circuit), a timing controlling part 150 (e.g., a timing controller), a glitch level detecting part 160 (e.g., a detection circuit) and a recovery timing control line load controlling part 200 (e.g., a controller circuit).

The display panel 110 receives a data signal DS from the data driving part 140 based on image data DATA provided to the timing controlling part 150 to display an image. For example, the image data DATA may be two-dimensional plane image data. Alternatively, the image data DATA may include a left-eye image data and a right-eye image data for displaying a three-dimensional stereoscopic image.

The display panel 110 includes gate lines GL, data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1. Each of the pixels 120 includes a thin film transistor 121 electrically connected to one of the gate lines GL and one of the data lines DL, a liquid crystal capacitor 123 and a storage capacitor 125 connected to the thin film transistor 121.

The gate driving part 130 generates a gate signal GS in response to a vertical start signal STV and a first clock signal CLK1 provided from the timing controlling part 150, and outputs the gate signal GS to the gate lines GL.

The data driving part 140 outputs the data signals DS to the data lines DL in response to a horizontal start signal STH provided from the timing controlling part 150 and a second clock signal CLK2 included in a display signal DIS provided from the timing controlling part 150. The data driving part 140 may include at least one data driving integrated circuit part 300 outputting the data signals DS to the data lines DL.

The timing controlling part 150 receives the image data DATA and a control signal CON from an outside source. The control signal CON may include a horizontal synchronous signal Hsync, a vertical synchronous signal Vsync and a clock signal CLK. The timing controlling part 150 outputs the image data DATA to the data driving part 140. In addition, the timing controlling part 150 generates the horizontal start signal STH using the horizontal synchronous signal Hsync and outputs the horizontal start signal STH to the data driving part 140. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 140. Here, the timing controlling part 150 may output the display signal DIS including the image data DATA and the second clock signal CLK2 to the data driving part 140. For example, the display signal DIS may be a differential signal, and the second clock signal CLK2 may be embedded in the image data DATA.

In addition, the timing controlling part 150 outputs a recovery timing control signal SFC to the data driving part 140 through a recovery timing control line SFCL. The recovery timing control signal SFC is a signal for controlling a recovery timing when the data driving part 140 recovers the second clock signal CLK2 from the display signal DIS including the image data DATA and the second clock signal CLK2. For example, when the recovery timing control signal SFC is a low level, the data driving part 140 recovers the second clock signal CLK2 from the display signal DIS. Alternatively, when the recovery timing control signal SFC is a high level, the data driving part 140 recovers the second clock signal CLK2 from the display signal DIS. For example, the data driving part 140 uses the state of the recovery timing control signal SFC to determine whether to interpret a current section of the display signal as image data or the second clock signal CLK2.

The glitch level detecting part 160 detects a glitch level in the recovery timing control signal SFC and outputs a glitch level signal GLS. The glitch level of the recovery timing control signal SFC may indicate a glitch degree and a glitch standard of the recovery timing control signal SFC. In an exemplary embodiment, the glitch level detecting part 160 detects that a glitch has occurred when it determines the recovery timing control signal SFC includes a voltage or current spike. For example, a spike is a fast, short duration electrical transient in voltage or current. For example, a spike can be detected by the detecting circuit in a signal when the voltage or current of the signal increases rapidly during a first period followed by a second period where the voltage or current of signal decreases rapidly, where the first and/or second periods are substantially shorter than the period during which the recovery timing control signal SFC is a level that indicates the second clock signal CLK2 is to be recovered or the image data is to be recovered from the display signal DIS.

The recovery timing control line load controlling part 200 is connected to the recovery timing control line SFCL transferring the recovery timing control signal SFC. The recovery timing control line load controlling part 200 controls a load of the recovery timing control line SFCL according to the glitch level signal GLS output from the glitch level detecting part 160. For example, the recovery timing control line load controlling part 200 increases the load of the recovery timing control line SFCL when the glitch level of the recovery timing control signal SFC is greater than a pre-defined threshold.

The gate driving part 130 (e.g., gate driver), the data driving part 140 (e.g., data driver), the timing controlling part 150 (e.g., timing controller), the glitch level detecting part 160 (e.g., detection circuit) and the recovery timing control line load controlling part 200 (e.g., load controlling circuit) may be part of a display panel driving apparatus driving the display panel 110.

Figure 2:
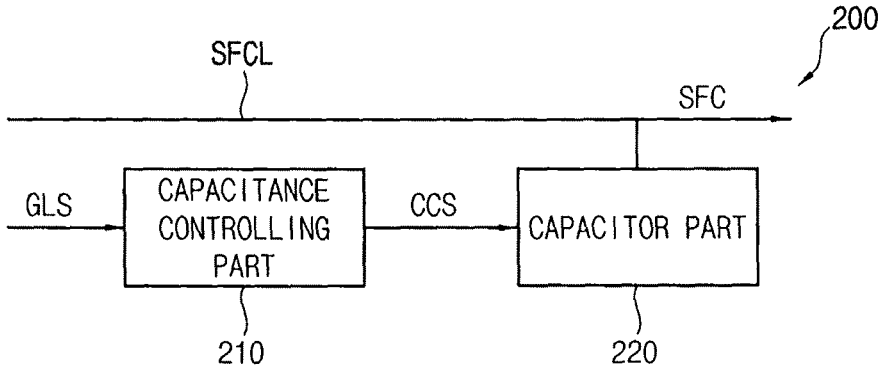
FIG. 2 is a block diagram illustrating a recovery timing control line load controlling part of FIG. 1 according to an exemplary embodiment of the present inventive concept.

FIG. 2 is a block diagram illustrating the recovery timing control line load controlling part 200 of FIG. 1 according to an exemplary embodiment of the inventive concept.

Referring to FIGS. 1 and 2, the recovery timing control line load controlling part 200 includes a capacitance controlling part 210 (e.g., capacitance controlling circuit) and a capacitor part 220 (e.g., a capacitor circuit).

The capacitance controlling part 210 receives the glitch level signal GLS output from the glitch level detecting part 160 and outputs a capacitance control signal CCS according to the glitch level signal GLS.

The capacitor part 220 receives the capacitance control signal CCS output from the capacitance controlling part 210 and controls a capacitance in the capacitor part 220 according to the capacitance control signal CCS. The recovery timing control line load controlling part 200 increases the capacitance of the capacitor part 220 connected to the recovery timing control line SFCL when the glitch level of the recovery timing control signal SFC is greater than a threshold. For example, when the glitch level is below the threshold, the capacitance of the capacitor part 220 is maintained or set to a normal capacitance. For example, when the glitch level is above the threshold, but less than a first amount, the capacitance is set to a first capacitance higher than the normal capacitance. For example, when the glitch level is above the threshold and higher than the first amount, the capacitance is set to a second capacitance higher than the first capacitance. In an exemplary embodiment, when the glitch level is below the threshold, the capacitor part 220 is disconnected from the recovery timing control line SFCL.

Figure 3:
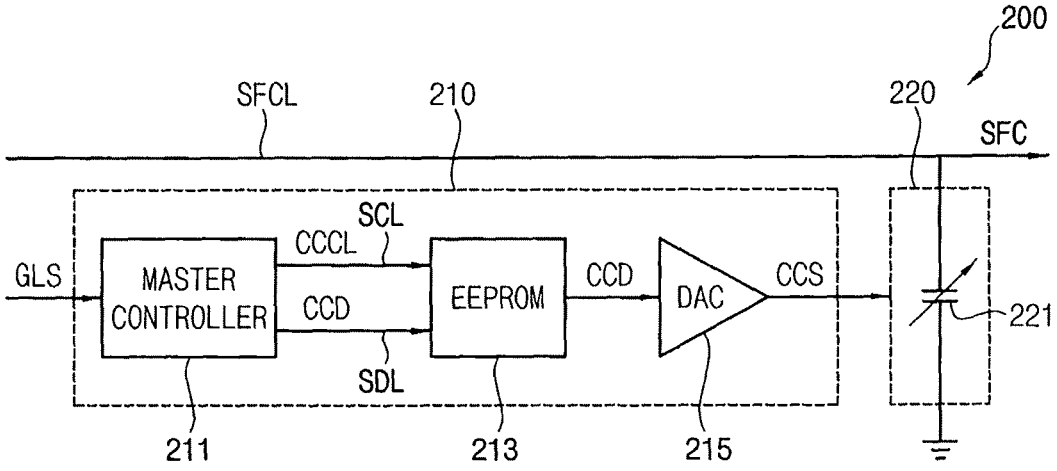
FIG. 3 is a circuit diagram illustrating a recovery timing control line load controlling part of FIGS. 1 and 2 according to an exemplary embodiment of the present inventive concept.

FIG. 3 is a circuit diagram illustrating the recovery timing control line load controlling part 200 of FIGS. 1 and 2 according to an exemplary embodiment of the inventive concept.

Referring to FIGS. 1 to 3, the recovery timing control line load controlling part 200 include the capacitance controlling part 210 and the capacitor part 220.

The capacitance controlling part 210 include a master controlling part 211 (e.g., a control circuit), a memory part 213 (e.g., a memory) and a digital to analog converting part 215 (e.g., a digital to analog converter).

The master controlling part 211 outputs capacitance control data CCD to the memory part 213 according to the glitch level signal GLS output from the glitch level detecting part 160. For example, the master controlling part 211 may transmit the capacitance control data CCD to the memory part 213 using an I2C communication. The capacitance control data CCD may be transmitted from the master controlling part 211 to the memory part 213 through a serial data line SDL, and a capacitance control clock CCCL may be transmitted from the master controlling part 211 to the memory part 213 through a serial clock line SCL.

The memory part 213 stores the capacitance control data CCD output from the master controlling part 211. For example, the memory part 213 may be an electrically erasable programmable read-only memory (EEPROM).

The digital to analog converting part 215 receives the capacitance control data CCD from the memory part 213 and outputs a capacitance control signal CCS by converting the capacitance control data CCD into an analog type. The capacitance control signal CCS may be a voltage signal.

In the present exemplary embodiment, the memory part 213 is disposed between the master controlling part 211 and the digital analog converting part 215, but the memory part 213 may be omitted. When the memory 213 is omitted, the capacitance control data CCD output from the master controlling part 211 may be directly transmitted to the digital to analog converting part 215.

The capacitor part 220 is connected to the recovery timing control line SFCL transferring the recovery timing control signal SFC. The capacitor part 220 controls the capacitance of the capacitor part 220 according to the capacitance control signal CCS output from the digital analog converting part 215. In an exemplary embodiment, the capacitor part 220 includes a variable capacitance diode 221. For example, the variable capacitance diode 221 may be a varactor device. In an embodiment, the variable capacitance diode 221 is connected between the recovery timing control line SFCL and a ground voltage. In an embodiment, element 221 is a varicap such as varicap capacitance diode.

Figure 4A:
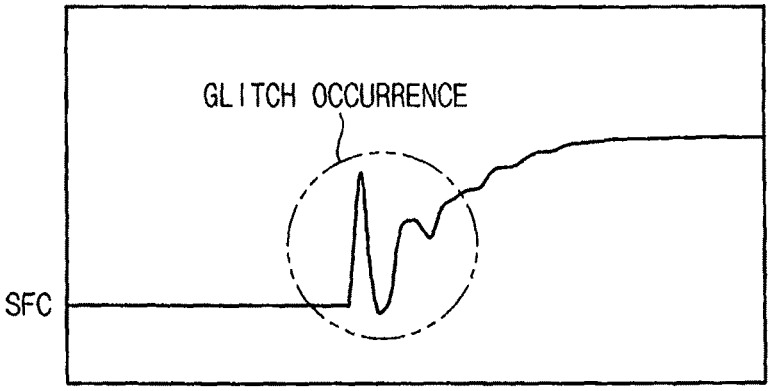
FIG. 4A is a waveform diagram illustrating a recovery timing control signal of FIG. 1 when the recovery timing control line load controlling part is not included in the display apparatus of FIG. 1.
Figure 4B:
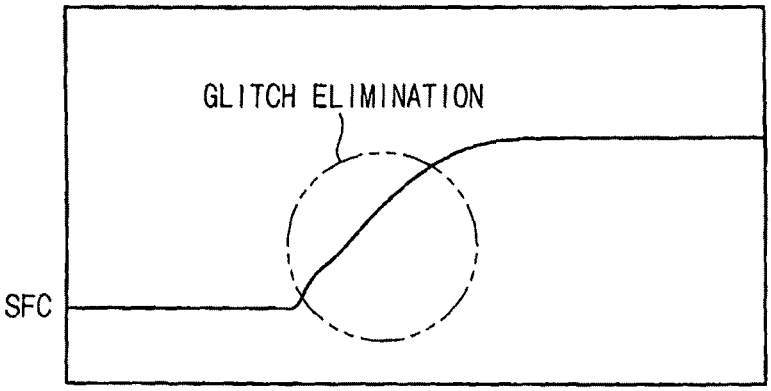
FIG. 4B is a waveform diagram illustrating the recovery timing control signal of FIG. 1 when the recovery timing control line load controlling part is included in the display apparatus of FIG. 1.

FIG. 4A is a waveform diagram illustrating the recovery timing control signal SFC of FIG. 1 when the recovery timing control line load controlling part 200 is not included in the display apparatus 100 of FIG. 1, and FIG. 4B is a waveform diagram illustrating the recovery timing control signal SFC of FIG. 1 when the recovery timing control line load controlling part 200 is included in the display apparatus 100 of FIG. 1.

Referring to FIGS. 1 to 4B, when the recovery timing control line load controlling part 200 is not included in the display apparatus 100, a glitch (e.g., a spike) may be generated in the recovery timing control signal SFC. However, when the recovery timing control line load controlling part 200 is included in the display apparatus 100, the glitch of the recovery timing control signal SFC may be removed.

Figure 5:
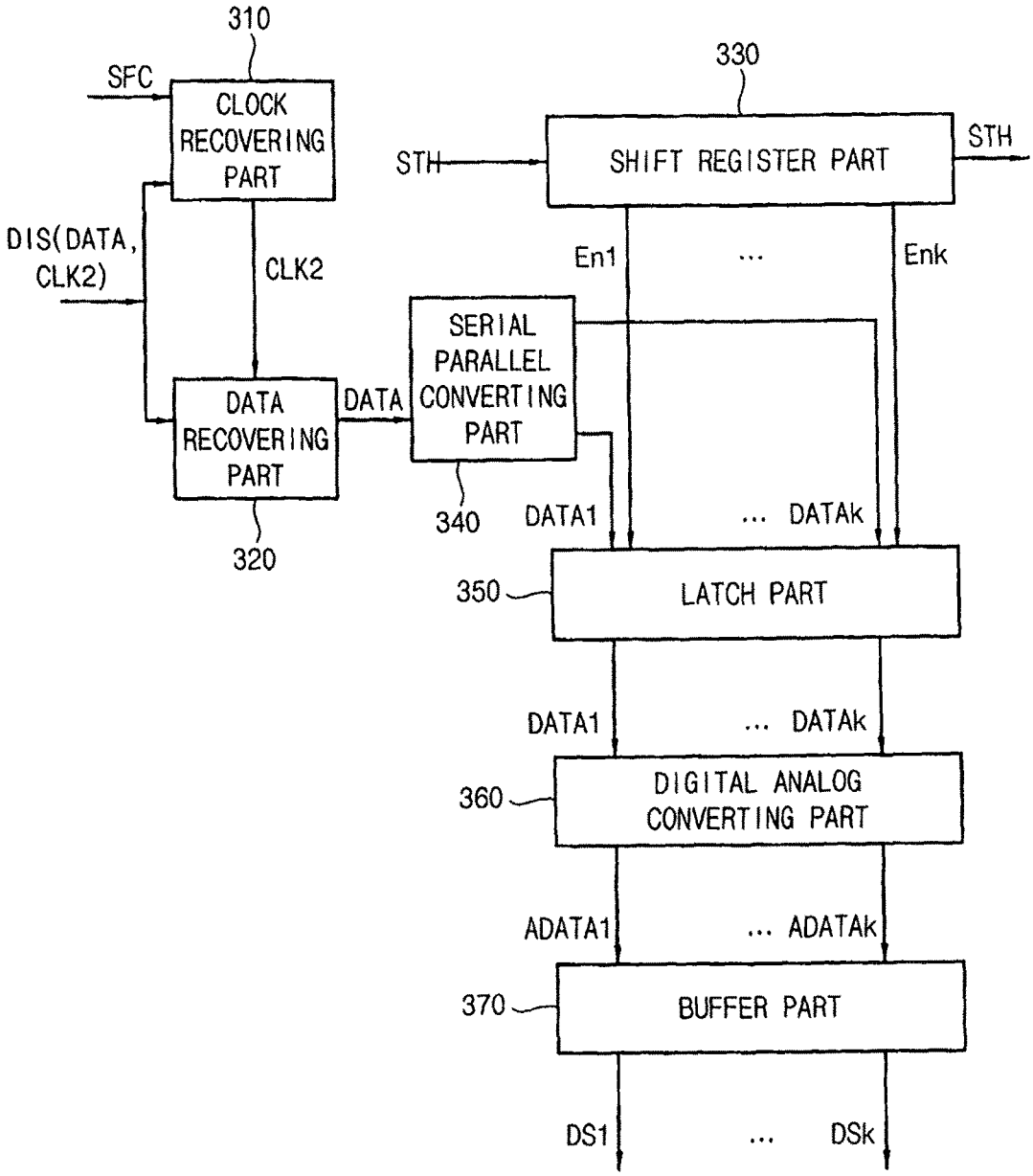
FIG. 5 is a block diagram illustrating a data driving circuit part of FIG. 1.

FIG. 5 is a block diagram illustrating the data driving circuit part 300 of FIG. 1.

Referring to FIGS. 1 and 5, the data driving circuit part 300 includes a clock recovering part 310 (e.g., a clock recovery circuit), the data recovering part 320 (e.g., data recovery circuit), the shift register part 330 (e.g., a shift register), a serial parallel converting part 340 (e.g., a serial to parallel converter), the latch part 350 (e.g., latch circuits), a digital to analog converting part 360 (e.g., digital to analog converter) and a buffer part 370 (e.g., a buffer such as one or more OP-AMPs).

The clock recovering part 310 recovers the second clock signal CLK2 from the display signal DIS including the image data DATA and the second clock signal CLK2. Specifically, the clock recovering part 310 recovers the second clock signal CLK2 from the display signal DIS according to the recovery timing control signal SFC during a vertical blank period when the data driving part 140 does not output the data signal DS to the data line DL. For example, the recovery timing control signal SFC may have a low level during the vertical blank period. Alternatively, the recovery timing control signal SFC may have a high level during the vertical blank period. In an exemplary embodiment, the clock recovering part 310 includes a Phase Locked Loop (PLL) circuit or a Delay Locked Loop (DLL) circuit in order to recover the second clock signal CLK2 from the display signal DIS. The clock recovering part 310 recovers the second clock signal CLK2 from the display signal DIS and outputs the second clock signal CLK2 to the data recovering part 320.

The data recovering part 320 recovers the image data DATA from the display signal DIS according to the second clock signal CLK2 received from the clock recovering part 310. The data recovering part 320 outputs the image data DATA to the serial parallel converting part 340.

The serial parallel converting part 340 receives the image data DATA from the data recovering part 320, and converts the image data DATA into parallel data DATA1 to DATAk to output the parallel data DATA1 to DATAk.

The shift register part 330 shifts the horizontal start signal STH to generate enable signals En1 to Enk, and provides the enable signals En1 to Enk to the latch part 350. The serial parallel converting part 340 provides the parallel data DATA1 to DATAk to the latch part 350. The enable signals En1 to Enk are used to control the latch part 350 to latch and output the parallel data DATA1 to DATAk with a particular timing.

The latch part 350 stores the parallel data DATA1 to DATAk, and outputs the parallel data DATA1 to DATAk to the digital to analog converting part 360.

The digital to analog converting part 360 receives the parallel data DATA1 to DATAk from the latch part 350, and converts the parallel data DATA1 into DATAk to analog data ADATA1 to ADATAk to output the analog data ADATA1 to ADATAk to the buffer part 370.

The buffer part 370 outputs data signals DS1 to DSk to the data lines DL of the display panel 110. Here, the data signals DS1 to DSk may be included in the data signals DS of FIG. 1.

Figure 6:
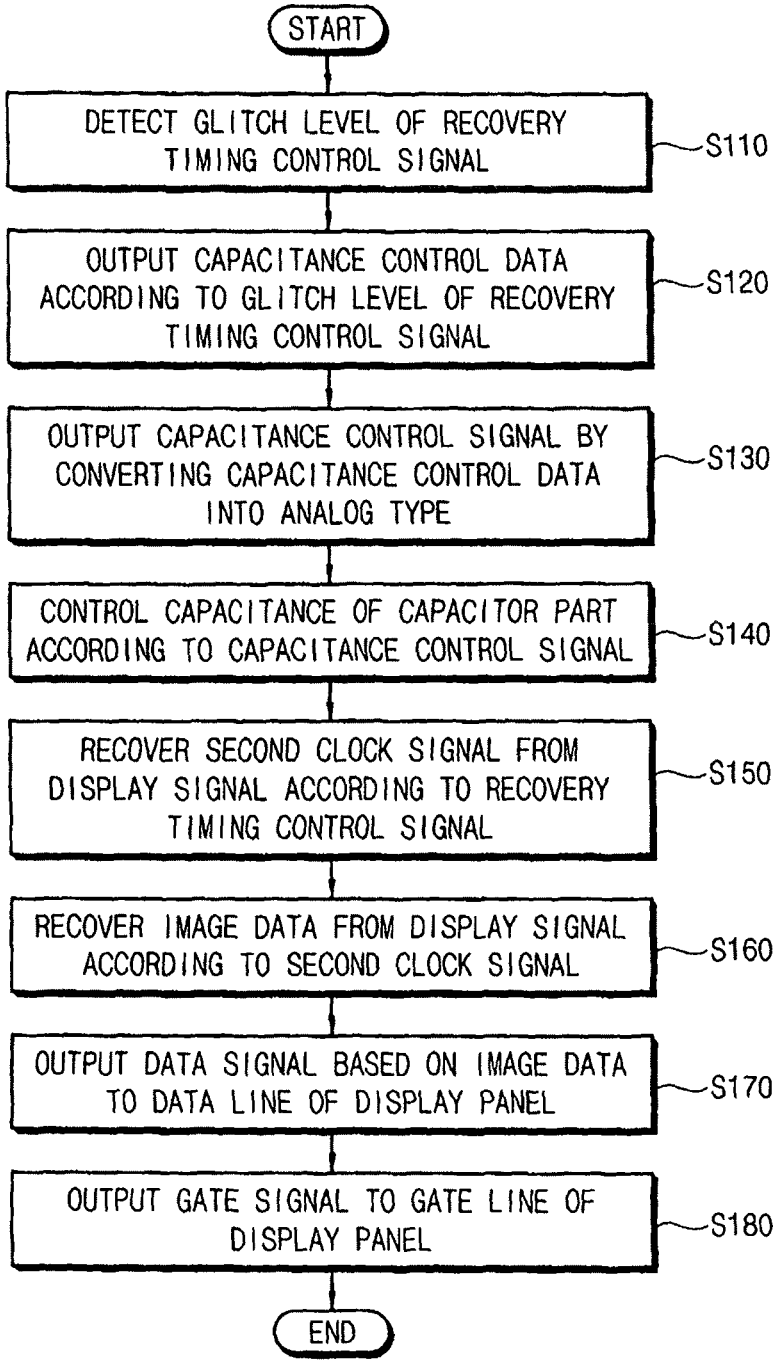
FIG. 6 is a flow chart illustrating a method of driving a display panel performed by a display panel driving apparatus of FIG. 1 according to an exemplary embodiment of the inventive concept.

FIG. 6 is a flow chart illustrating a method of driving a display panel performed by the display panel driving apparatus of FIG. 1 according to an exemplary embodiment of the inventive concept.

Referring to FIGS. 1 to 3 and 6, the glitch level of the recovery timing control signal SFC is detected (step S110). Specifically, the glitch level detecting part 160 detects the glitch level of the recovery timing control signal SFC and outputs the glitch level signal GLS.

The capacitance control data CCD is output according to the glitch level of the recovery timing control signal SFC (step S120). Specifically, the master controlling part 211 outputs the capacitance control data CCD to the memory part 213 according to the glitch level signal GLS output from the glitch level detecting part 160.

The capacitance control data CCD is converted into the analog type and the capacitance control signal CCS is output (step S130). Specifically, the digital analog converting part 215 receives the capacitance control data CCD and outputs the capacitance control signal CCS by converting the capacitance control data CCD into the analog type.

The capacitance of the capacitor part 220 is controlled according to the capacitance control signal CCS (step S140). Specifically, the capacitor part 220 is connected to the recovery timing control line SFCL transferring the recovery timing control signal SFC. The capacitor part 220 controls the capacitance of the capacitor part 220 according to the capacitance control signal CCS output from the digital analog converting part 215.

The second clock signal CLK2 is recovered from the display signal DIS according to the recovery timing control signal SFC (step S150). Specifically, the clock recovering part 310 recovers the second clock signal CLK2 from the display signal DIS including the image data DATA and the second clock signal CLK2. The clock recovering part 310 recovers the second clock signal CLK2 from the display signal DIS according to the recovery timing control signal SFC during the vertical blank period when the data driving part 140 does not output the data signal DS to the data line DL. For example, the recovery timing control signal SFC may have a low level during the vertical blank period. Alternatively, the recovery timing control signal SFC may have a high level during the vertical blank period.

The image data DATA is recovered from the display signal DIS according to the second clock signal CLK2 (step S160). Specifically, the data recovering part 320 recovers the image data DATA from the display signal DIS according to the second clock signal CLK2 received from the clock recovering part 310. The data recovering part 320 outputs the image data DATA to the serial parallel converting part 340.

The data signal DS based on the image data DATA is output to the data line DL of the display panel 110 (step S170). Specifically, the serial parallel converting part 340 receives the image data DATA from the data recovering part 320, and converts the image data DATA into parallel data DATA1 to DATAk to output the parallel data DATA1 to DATAk. The shift register part 330 shifts the horizontal start signal STH and provides the parallel data DATA1 to DATAk to the latch part 350. The latch part 350 stores the parallel data DATA1 to DATAk, and outputs the parallel data DATA1 to DATAk to the digital to analog converting part 360. The digital to analog converting part 360 receives the parallel data DATA1 to DATAk from the latch part 350, and converts the parallel data DATA1 into DATAk to analog data ADATA1 to ADATAk to output the analog data ADATA1 to ADATAk to the buffer part 370. The buffer part 370 outputs data signals DS1 to DSk to the data lines DL of the display panel 110. Here, the data signals DS1 to DSk may be included in the data signals DS of FIG. 1.

The gate signal GS is output to the gate line GL of the display panel 110 (step S180). Specifically, the gate driving part 130 generates the gate signal GS in response to the vertical start signal STV and the first clock signal CLK1 provided from the timing controlling part 150, and outputs the gate signal GS to the gate line GL. Thus, the image is displayed on the display panel 110.

According to the present exemplary embodiment, since the load of the recovery timing control line SFCL is controlled according to the glitch level of the recovery timing control signal SFC, the glitch generated in the recovery timing control signal SFC may be decreased or removed. Thus, an error in which the data driving part 140 recognizes a high level of the recovery timing control signal SFC as a low level or recognizes a low level of the recovery timing control signal SFC as a high level may be prevented. Therefore, an operation error of the data driving part 140 may be prevented, and thus display quality of the display apparatus 100 may be improved.

Figure 7:
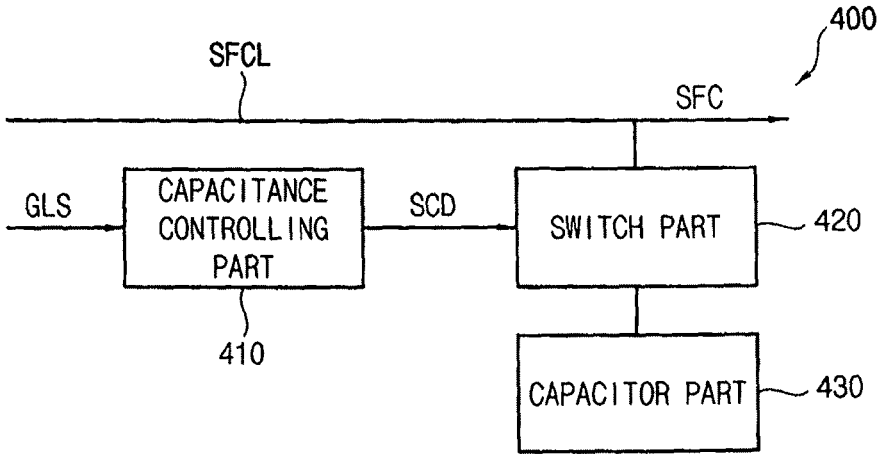
FIG. 7 is a block diagram illustrating a recovery timing control line load controlling part according to an exemplary embodiment of the present inventive concept.

FIG. 7 is a block diagram illustrating a recovery timing control line load controlling part 400 according to an exemplary embodiment of the present inventive concept.

The recovery timing control line load controlling part 400 according to the present exemplary embodiment may replace the recovery timing control line load controlling part 200 of FIG. 1. Thus, the same reference numerals will be used to refer to same or like parts as those described in the previous exemplary embodiment and any further repetitive explanation concerning the above elements will be omitted.

Referring to FIGS. 1 and 7, the recovery timing control line load controlling part 400 includes a capacitance controlling part 410 (e.g., a controller circuit), a switch part 420 (e.g., switches) and a capacitor part 430 (e.g., capacitors).

The recovery timing control line load controlling part 400 is connected to the recovery timing control line SFCL transferring the recovery timing control signal SFC. The recovery timing control line load controlling part 400 controls the load of the recovery timing control line SFCL according to the glitch level signal GLS output from the glitch level detecting part 160. For example, the recovery timing control line load controlling part 400 increases the load of the recovery timing control line SFCL when the glitch level of the recovery timing control signal SFC is greater than a threshold. For example, when the glitch level is below the threshold, the level of the load is maintained or set to a normal load level. For example, if the glitch level is above the threshold, but less than a first amount, the load is increased to a first load level above the normal load level. For example, if the glitch level is above the threshold and above the first amount, the load is increased to a second load level above the first load level.

The gate driving part 130, the data driving part 140, the timing controlling part 150, the glitch level detecting part 160 and the recovery timing control line load controlling part 400 may be part of a display panel driving apparatus driving the display panel 110.

The capacitance controlling part 410 receives the glitch level signal GLS output from the glitch level detecting part 160 and outputs switch control data SCD according to the glitch level signal GLS.

The switch part 420 includes a switch which opens or closes according to the switch control data SCD output from the capacitance controlling part 410.

The capacitor part 430 includes a capacitor connected to or disconnected from the recovery timing control line SFCL through the switch part 420. The recovery timing control line load controlling part 400 increases a capacitance of the capacitor part 430 connected to the recovery timing control line SFCL when the glitch level of the recovery timing control signal SFC is greater than a threshold. For example, when the glitch level is below a first level, the recovery timing control line load controlling part 400 maintains a capacitance of the capacitor part 430 at a normal capacitance. For example, when the glitch level is between the first level and a second level, the recovery timing control line load controlling part 400 increase a capacitance of the capacitor part 430 to a first capacitance that is higher than the normal capacitance. For example, when the glitch level is between the second level and a third higher level, the recovery timing control line load controlling part 400 increase a capacitance of the capacitor part 430 to a second capacitance higher than the first capacitance.

Figure 8:
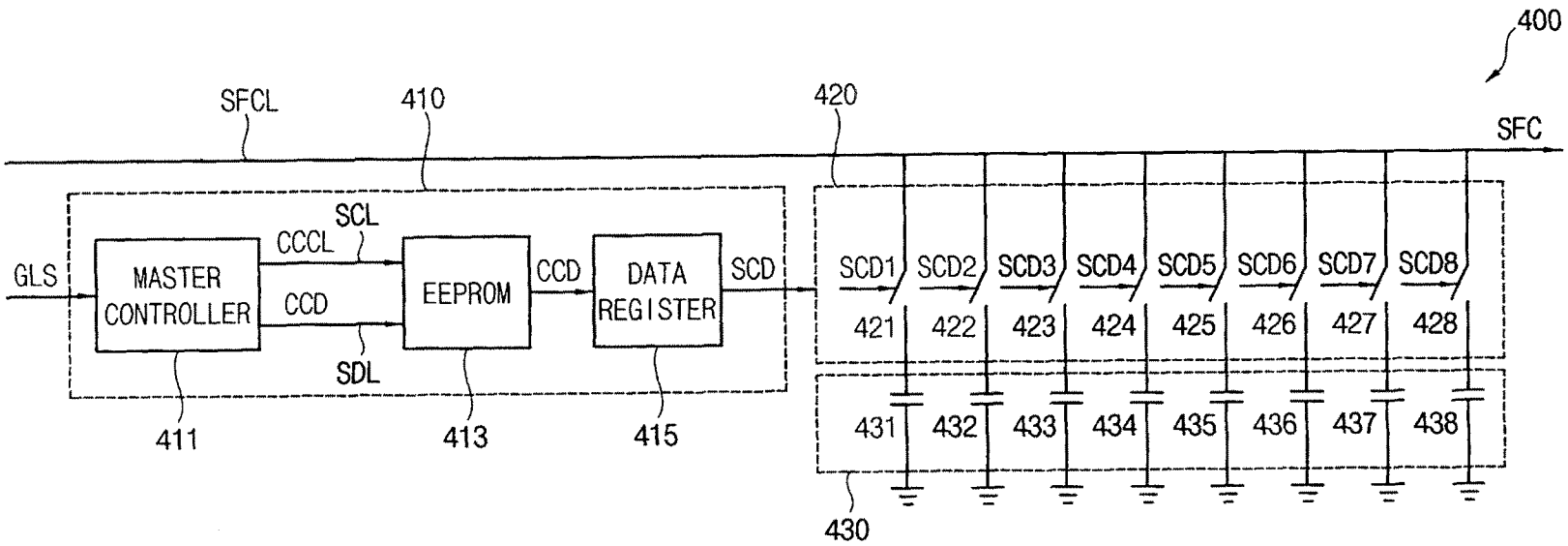
FIG. 8 is a circuit diagram illustrating the recovery timing control line load controlling part of FIG. 7.

FIG. 8 is a circuit diagram illustrating the recovery timing control line load controlling part 400 of FIG. 7 according to an exemplary embodiment of the inventive concept.

Referring to FIGS. 7 and 8, the recovery timing control line load controlling part 400 includes the capacitance controlling part 410, the switch part 420 and the capacitor part 430.

The capacitance controlling part 410 include a master controlling part 411 (e.g., a controller circuit), a memory part 413 (e.g., a memory) and a data register part 415 (e.g., one or more registers).

The master controlling part 411 outputs the capacitance control data CCD to the memory part 413 according to the glitch level signal GLS output from the glitch level detecting part 160. For example, the master controlling part 411 may transmit the capacitance control data CCD to the memory part 413 using an I2C communication. The capacitance control data CCD may be transmitted from the master controlling part 411 to the memory part 413 through a serial data line SDL, and a capacitance control clock CCCL may be transmitted from the master controlling part 411 to the memory part 413 through a serial clock line SCL.

The memory part 413 stores the capacitance control data CCD output from the master controlling part 411. For example, the memory part 413 may be an EEPROM.

The data register part 415 receives the capacitance control data CCD from the memory part 413, and outputs the switch control data SCD according to the capacitance control data CCD.

In the present exemplary embodiment, the memory part 413 is disposed between the master controlling part 411 and the data register part 415, but the memory part 413 may be omitted. When the memory part 413 is omitted, the capacitance control data CCD output from the master controlling part 411 may be directly transmitted to the data register part 415.

The switch part 420 is connected between the recovery timing control line SFCL and the capacitor part 430. In addition, the switch part 420 may include at least one switch. For example, as shown in FIG. 8, the switch part 420 may include a first switch 421, a second switch 422, a third switch 423, a fourth switch 424, a fifth switch 425, a sixth switch 426, a seventh switch 427 and an eighth switch 428. Each of the first switch 421, the second switch 422, the third switch 423, the fourth switch 424, the fifth switch 425, the sixth switch 426, the seventh switch 427 and the eighth switch 428 may open or close according to the switch control data SCD output from the data register part 415. In this case, the switch control data SCD may be eight bits of data. The first switch 421 may open or close according to first switch control data SDC1 of the switch control data SCD. The second switch 422 may open or closed according to second switch control data SDC2 of the switch control data SCD. The third switch 423 may open or close according to third switch control data SDC3 of the switch control data SCD. The fourth switch 424 may open or close according to fourth switch control data SDC4 of the switch control data SCD. The fifth switch 425 may open or close according to fifth switch control data SDC5 of the switch control data SCD. The sixth switch 426 may open or close according to sixth switch control data SDC6 of the switch control data SCD. The seventh switch 427 may open or closed according to seventh switch control data SDC7 of the switch control data SCD. The eighth switch 428 may open or close according to eighth switch control data SDC8 of the switch control data SCD.

The capacitor part 430 is connected to or disconnected from the recovery timing control line SFCL through the switch part 420. The capacitor part 430 includes a capacitor of the number corresponding to the number of the switch. For example, as shown in FIG. 8, the capacitor part 430 may include a first capacitor 431, a second capacitor 432, a third capacitor 433, a fourth capacitor 434, a fifth capacitor 435, a sixth capacitor 436, a seventh capacitor 437 and an eighth capacitor 438. In this case, the first capacitor 431 may be connected to or disconnected from the recovery timing control line SFCL through the first switch 421. The second capacitor 432 may be connected to or disconnected from the recovery timing control line SFCL through the second switch 422. In an embodiment, each of the capacitors is connected at one end to a ground voltage. The third capacitor 433 may be connected to or disconnected from the recovery timing control line SFCL through the third switch 423. The fourth capacitor 434 may be connected to or disconnected from the recovery timing control line SFCL through the fourth switch 424. The fifth capacitor 435 may be connected to or disconnected from the recovery timing control line SFCL through the fifth switch 425. The sixth capacitor 436 may be connected to or disconnected from the recovery timing control line SFCL through the sixth switch 426. The seventh capacitor 437 may be connected to or disconnected from the recovery timing control line SFCL through the seventh switch 427. The eighth capacitor 438 may be connected to or disconnected from the recovery timing control line SFCL through the eighth switch 428.

For example, the greater the glitch level of the recovery timing control signal SFC is, the more capacitors of the capacitor part 430 are connected to the recovery timing control line SFCL.

Figure 9:
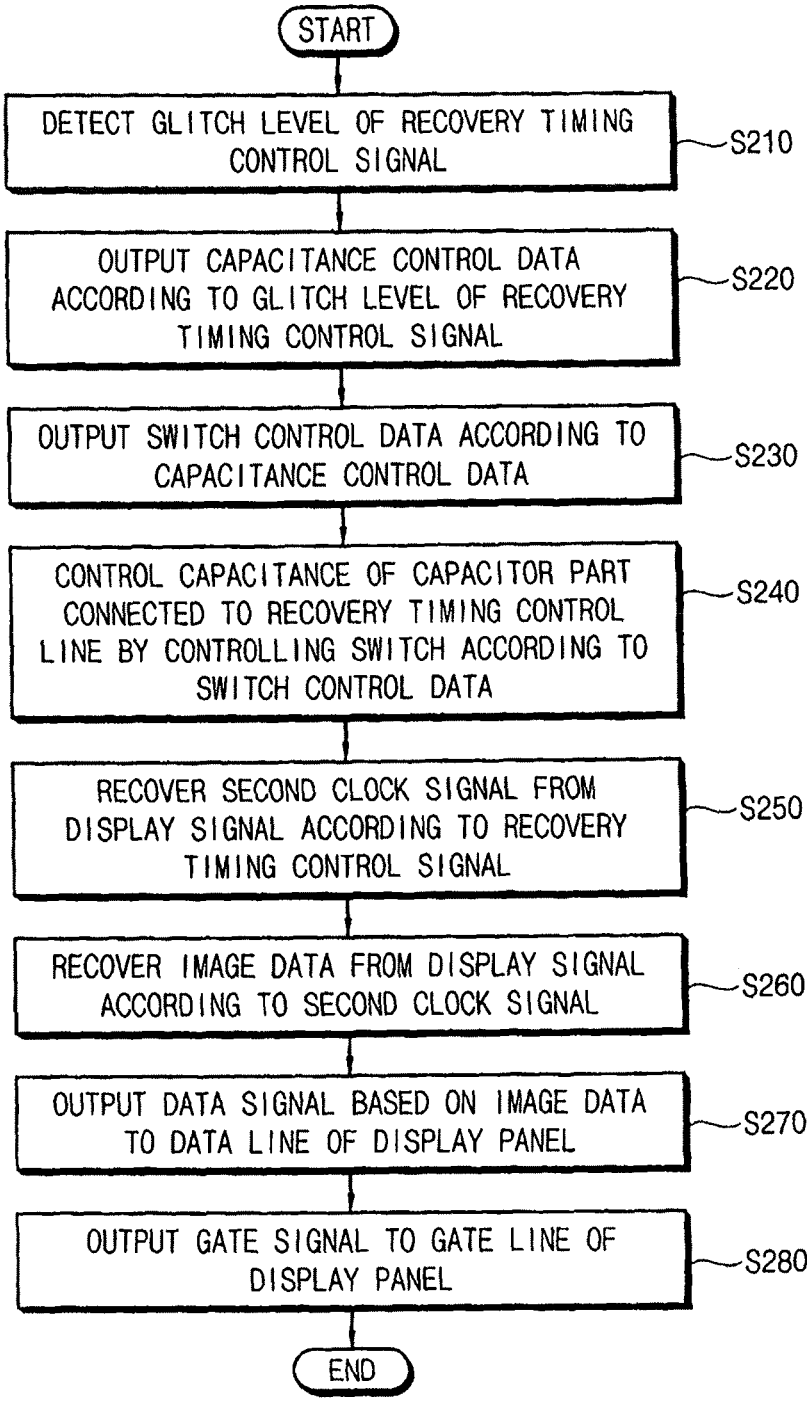
FIG. 9 is a flow chart illustrating a method of driving a display panel performed by a display panel driving apparatus including the recovery timing control line load controlling part of FIG. 7 according to an exemplary embodiment of the inventive concept.

FIG. 9 is a flow chart illustrating a method of driving a display panel performed by the display panel driving apparatus including the recovery timing control line load controlling part 400 of FIG. 7 according to an exemplary embodiment of the inventive concept.

Referring to FIGS. 1, 5 and 7 to 9, the glitch level of the recovery timing control signal SFC is detected (step S210). Specifically, the glitch level detecting part 160 detects the glitch level of the recovery timing control signal SFC and outputs the glitch level signal GLS.

The capacitance control data CCD is output according to the glitch level of the recovery timing control signal SFC (step S220). Specifically, The master controlling part 411 outputs the capacitance control data CCD to the memory part 413 according to the glitch level signal GLS output from the glitch level detecting part 160.

The switch control data SCD is output according to the capacitance control data CCD (step S230). Specifically, data register part 415 receives the capacitance control data CCD and outputs the switch control data SCD according to the capacitance control data CCD.

The capacitance of the capacitor part 430 connected to the recovery timing control line SFCL is controlled by controlling the switch according to the switch control data SCD (step S240). Specifically, the switch part 420 is connected between the recovery timing control line SFCL and the capacitor part 430. In addition, the switch part 420 may include at least one switch. For example, as shown in FIG. 8, the switch part 420 may include the first switch 421, the second switch 422, the third switch 423, the fourth switch 424, the fifth switch 425, the sixth switch 426, the seventh switch 427 and the eighth switch 428. Each of the first switch 421, the second switch 422, the third switch 423, the fourth switch 424, the fifth switch 425, the sixth switch 426, the seventh switch 427 and the eighth switch 428 may open or close according to the switch control data SCD output from the data register part 415. In this case, the switch control data SCD may be eight bits of data. The first switch 421 may open or close according to first switch control data SDC1 of the switch control data SCD. The second switch 422 may open or close according to second switch control data SDC2 of the switch control data SCD. The third switch 423 may open or close according to third switch control data SDC3 of the switch control data SCD. The fourth switch 424 may open or close according to fourth switch control data SDC4 of the switch control data SCD. The fifth switch 425 may open or close according to fifth switch control data SDC5 of the switch control data SCD. The sixth switch 426 may open or close according to sixth switch control data SDC6 of the switch control data SCD. The seventh switch 427 may open or close according to seventh switch control data SDC7 of the switch control data SCD. The eighth switch 428 may open or close according to eighth switch control data SDC8 of the switch control data SCD.

The capacitor part 430 is connected to or disconnected from the recovery timing control line SFCL through the switch part 420. The capacitor part 430 includes the capacitor of the number corresponding to the number of the switch. For example, as shown in FIG. 8, the capacitor part 430 may include the first capacitor 431, the second capacitor 432, the third capacitor 433, the fourth capacitor 434, the fifth capacitor 435, the sixth capacitor 436, the seventh capacitor 437 and the eighth capacitor 438. In this case, the first capacitor 431 may be connected to or disconnected from the recovery timing control line SFCL through the first switch 421. The second capacitor 432 may be connected to or disconnected from the recovery timing control line SFCL through the second switch 422. The third capacitor 433 may be connected to or disconnected from the recovery timing control line SFCL through the third switch 423. The fourth capacitor 434 may be connected to or disconnected from the recovery timing control line SFCL through the fourth switch 424. The fifth capacitor 435 may be connected to or disconnected from the recovery timing control line SFCL through the fifth switch 425. The sixth capacitor 436 may be connected to or disconnected from the recovery timing control line SFCL through the sixth switch 426. The seventh capacitor 437 may be connected to or disconnected from the recovery timing control line SFCL through the seventh switch 427. The eighth capacitor 438 may be connected to or disconnected from the recovery timing control line SFCL through the eighth switch 428.

For example, the greater the glitch level of the recovery timing control signal SFC is, the more capacitors of the capacitor part 430 are connected to the recovery timing control line SFCL.

The second clock signal CLK2 is recovered from the display signal DIS according to the recovery timing control signal SFC (step S250). Specifically, the clock recovering part 310 recovers the second clock signal CLK2 from the display signal DIS including the image data DATA and the second clock signal CLK2. The clock recovering part 310 recovers the second clock signal CLK2 from the display signal DIS according to the recovery timing control signal SFC during the vertical blank period when the data driving part 140 does not output the data signal DS to the data line DL. For example, the recovery timing control signal SFC may have a low level during the vertical blank period. Alternatively, the recovery timing control signal SFC may have a high level during the vertical blank period.

The image data DATA is recovered from the display signal DIS according to the second clock signal CLK2 (step S260). Specifically, the data recovering part 320 recovers the image data DATA from the display signal DIS according to the second clock signal CLK2 received from the clock recovering part 310. The data recovering part 320 outputs the image data DATA to the serial parallel converting part 340.

The data signal DS based on the image data DATA is output to the data line DL of the display panel 110 (step S270). Specifically, the serial parallel converting part 340 receives the image data DATA from the data recovering part 320, and converts the image data DATA into parallel data DATA1 to DATAk to output the parallel data DATA1 to DATAk. The shift register part 330 shifts the horizontal start signal STH and provides the parallel data DATA1 to DATAk to the latch part 350. The latch part 350 stores the parallel data DATA1 to DATAk, and outputs the parallel data DATA1 to DATAk to the digital to analog converting part 360. The digital to analog converting part 360 receives the parallel data DATA1 to DATAk from the latch part 350, and converts the parallel data DATA1 into DATAk to analog data ADATA1 to ADATAk to output the analog data ADATA1 to ADATAk to the buffer part 370. The buffer part 370 outputs data signals DS1 to DSk to the data lines DL of the display panel 110. Here, the data signals DS1 to DSk may be included in the data signals DS of FIG. 1.

The gate signal GS is output to the gate line GL of the display panel 110 (step S280). Specifically, the gate driving part 130 generates the gate signal GS in response to the vertical start signal STV and the first clock signal CLK1 provided from the timing controlling part 150, and outputs the gate signal GS to the gate line GL. Thus, the image is displayed on the display panel 110.

According to the present exemplary embodiment, since the load of the recovery timing control line SFCL is controlled according to the glitch level of the recovery timing control signal SFC, the glitch generated in the recovery timing control signal SFC may be decreased or removed. Thus, an error in which the data driving part 140 recognizes a high level of the recovery timing control signal SFC as a low level or recognizes a low level of the recovery timing control signal SFC as a high level may be prevented. Therefore, an operation error of the data driving part 140 may be prevented, and thus display quality of the display apparatus 100 may be improved.

Embodiments of the inventive concept provide a display panel driving apparatus, a method of driving a display panel using the display panel driving apparatus, and a display apparatus having the display panel driving apparatus. Since a load of a recovery timing control line transferring a recovery timing control signal for controlling a recovery timing when a clock signal is recovered from a display signal including image data and the clock signal is controlled according to a glitch level of the recovery timing control signal, a glitch generated in the recovery timing control signal may be decreased or removed. Thus, an error in which a data driving part recognizes a high level of the recovery timing control signal as a low level or recognizes a low level of the recovery timing control signal as a high level may be prevented. Therefore, an operation error of the data driving part may be prevented, and thus display quality of a display apparatus may be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from present inventive concept. Accordingly, all such modifications are intended to be included within the scope of the present inventive concept.

What is claimed is:

1. A display panel driving apparatus comprising:

a load controlling circuit connected to a control line transferring a recovery timing control signal for controlling recovery of a clock signal from a display signal including image data and the clock signal, and configured to control a load of the control line according to a glitch level of the recovery timing control signal;

a data driver configured to receive the display signal, receive the recovery timing control signal through a connection to the control line, recover the clock signal from the display signal according to the recovery timing control signal, and output a data signal based on the image data to a data line of a display panel; and a gate driver configured to output a gate signal to a gate line of the display panel.

2. The display panel driving apparatus of claim 1, further comprising:

detecting circuit configured to detect the glitch level of the recovery timing control signal to output a glitch level signal indicating the glitch level.

3. The display panel driving apparatus of claim 2, wherein the load controlling circuit receives the glitch level signal output from the detecting circuit and controls the load of the control line according to the glitch level of the recovery timing control signal.

4. The display panel driving apparatus of claim 1, wherein the load controlling circuit comprises:

a capacitance controlling circuit configured to receive the glitch level signal output from the detecting circuit and output a capacitance control signal according to the glitch level of the recovery timing control signal; and a capacitor circuit connected to the control line and changing a capacitance according to the capacitance control signal output from the capacitance controlling circuit.

5. The display panel driving apparatus of claim 4, wherein the capacitance controlling circuit comprises:

a control circuit configured to output capacitance control data according to the glitch level signal output from the detecting circuit; and a digital to analog converter configured to convert the capacitance control data output from the control circuit into an analog type to output the capacitance control signal.

6. The display panel driving apparatus of claim 5, wherein the capacitance controlling circuit further comprises a memory disposed between the control circuit and the digital to analog converter to store the capacitance control data output from the control circuit.

7. The display panel driving apparatus of claim 4, wherein the capacitor circuit comprises a variable capacitance diode of which the capacitance is controlled according to the capacitance control signal.

8. The display panel driving apparatus of claim 7, wherein the variable capacitance diode includes a varactor device.

9. The display panel driving apparatus of claim 1, wherein the load controlling circuit comprises:

a capacitance controlling circuit configured to receive the glitch level signal output from the detecting circuit and output switch control data according to the glitch level of the recovery timing control signal;

a switch circuit configured to open and close according to the switch control data output from the capacitance controlling circuit; and a capacitor circuit including a capacitor configured to be connected to or disconnected from the control line through the switch circuit.

10. The display panel driving apparatus of claim 9, wherein the capacitance controlling circuit comprises:

a control circuit configured to output capacitance control data according to the glitch level signal output from the detecting circuit; and a data register configured to output the switch control data according to the capacitance control data output from the control circuit.

11. The display panel driving apparatus of claim 10, wherein the capacitance controlling circuit further comprises a memory disposed between the control circuit and the data register to store the capacitance control data output from the control circuit.

12. The display panel driving apparatus of claim 9, wherein the switch circuit includes at least one switch opens or closes according to the switch control data.

13. The display panel driving apparatus of claim 12, wherein the capacitor circuit includes at least one capacitor connected to the switch.

14. The display panel driving apparatus of claim 1, wherein the load controlling circuit increases the load of the control line when the glitch level of the recovery timing control signal is greater than a threshold.

15. A method of driving a display panel, the method comprising:

detecting a glitch level of a recovery timing control signal for controlling recovery of a clock signal from a display signal including image data and the clock signal;

controlling a load of a control line transferring the recovery timing control signal according to the glitch level of the recovery timing control signal;

recovering the clock signal from the display signal according to the recovery timing control signal;

recovering the image data from the display signal according to the clock signal;

outputting a data signal based on the image data to a data line of the display panel; and outputting a gate signal to a gate line of the display panel.

16. The method of claim 15, wherein the controlling the load of the control line according to the glitch level of the recovery timing control signal comprises changing a capacitance of a capacitor circuit connected to the control line.

17. The method of claim 16, wherein the controlling the capacitance of the capacitor circuit comprises:

outputting capacitance control data according to the glitch level of the recovery timing control signal;

outputting a capacitance control signal by converting the capacitance control data into an analog type; and controlling the capacitance of the capacitor circuit according to the capacitance control signal.

18. The method of claim 16, wherein the controlling the capacitance of the capacitor circuit comprises:

outputting capacitance control data according to the glitch level of the recovery timing control signal;

outputting switch control data according to the capacitance control data; and controlling the capacitance of the capacitor circuit connected to the control line by controlling a switch disposed between the control line and the capacitor circuit according to the switch control data.

19. The method of claim 15, wherein the controlling the load of the control line comprises increasing the load of the recovery timing control line when the glitch level of the recovery timing control signal is greater than a threshold.

20. A display apparatus comprising:

a display panel including a gate line, a data line and a pixel electrode electrically connected to the gate line and the data line; and a display panel driving apparatus comprising a load controlling circuit connected to a control line transferring a recovery timing control signal for controlling a recovery timing when a clock signal is recovered from a display signal including image data and the clock signal and configured to control a load of the control line according to a glitch level of the recovery timing control signal, a data driver configured to receive the display signal, receive the recovery timing control signal through a connection to the control line, recover the clock signal from the display signal according to the recovery timing control signal and output a data signal based on the image data to the data line of the display panel, and a gate driver configured to output a gate signal to the gate line of the display panel.

* * * * *